US005417596A

United States Patent [19]

Kusakabe

[11] Patent Number: 5,417,596

[45] Date of Patent: May 23, 1995

[54] MULTIPOLAR ELECTRICAL CONNECTOR FOR A MEMORY CARD

[75] Inventor: Toshihito Kusakabe, Ibaraki, Japan

[73] Assignee: Hosiden Corporation, Yao, Japan

[21] Appl. No.: 130,909

[22] Filed: Oct. 4, 1993

[30] Foreign Application Priority Data

Oct. 12, 1992 [JP] Japan ..... 4-070862 U

[51] Int. Cl.[6] ..... H01R 13/11

[52] U.S. Cl. ..... 439/857; 439/95

[58] Field of Search ..... 439/856, 857, 95

[56] References Cited

U.S. PATENT DOCUMENTS 3,907,392 9/1975 Haag et al. ..... 439/856 X
3,955,869 5/1976 Licht ..... 439/857 X
4,607,907 8/1986 Bogursky ..... 439/856 X
5,330,360 7/1994 Marsh et al. ..... 439/95 X

*Primary Examiner*—Z. R. Bilinsky
*Attorney, Agent, or Firm*—Jones, Tullar & Cooper

[57] ABSTRACT

The invention relates to a multipolar electrical connector which is to be attached to the body of a memory card. The body of the connector has a plurality of pin terminal insertion spaces into which pin terminals of a counter connector are to be respectively inserted. In each of the pin terminal insertion spaces, a first contact piece having a contact located more forward than a rocking fulcrum, and a second contact piece 6 having a contact located more rearward than a rocking fulcrum are opposed to each other, and the contact of the second contact piece is located more rearward than the contact of the first contact piece. A temporary shift between the timings with respect to pin terminals of a counter connector which have different lengths can be assured, and the force required for inserting the pin terminals is suppressed to a small degree.

8 Claims, 7 Drawing Sheets

MULTIPOLAR ELECTRICAL CONNECTOR FOR A MEMORY CARD

BACKGROUND OF THE INVENTION

1. Field of the Invention

The present invention relates to a multipolar electrical connector which is to be disposed on a memory card such as an IC card, in order to connect various devices mounted on the memory card with electronic circuits of a computer system.

2. Description of the Prior Art

Such a multipolar electrical connector for a memory card (hereinafter, referred to as merely "connector") is attached to the front end portion of the body of the memory card so as to be united with the body of the memory card. The connector has an electrically insulating body wherein a number of pin terminal insertion spaces into which pin terminals of a counter multipolar electrical connector (hereinafter, referred to as merely "counter connector") are to be respectively inserted are formed. In each of the pin terminal insertion spaces, a contact piece which functions as a contact and which corresponds to a pin terminal of the counter connector is housed.

Conventionally, connectors having such a configuration, are known, such as those shown in FIGS. 7 to 10. These have a number of contacts (number of contacting points) for pin terminals of a counter connector, and a positional relationship in the front-to-back direction between a contact with which a pin terminal of a counter connector contacts and the rocking fulcrum of a contact piece.

The connector shown in FIG. 7 comprises an insulating body A in which pin terminal insertion spaces B are formed. In each of the pin terminal insertion spaces B, a pair of plate-like elongated contact pieces C, C which extend in the pin terminal insertion and extraction direction X are symmetrically arranged. The contact pieces C, C are electrically connected with each other by a short-circuit portion D made of a thin metal plate. The short-circuit portion D and the paired contact pieces C, C are formed into one body by punching or bending a thin metal plate which is common to them.

The connector of FIG. 8 comprises a pair of contact pieces C, C and a short-circuit portion D which also are formed by punching a thin metal plate. The edge faces (which are formed as a result of a punching process of the thin metal plate) of the contact pieces C, C function as contacts F, F.

In the connector of FIG. 9, contacts F, F of paired contact pieces C, C are positionally shifted in the front-to-back direction, and the base portions of the contact pieces C, C are electrically connected with each other by a short-circuit portion D.

In the pair of contact pieces C, C used in the connectors of FIGS. 7, 8 and 9, the contacts F, F corresponding to a pin terminal G1 or G2 are at positions (given positions in the pin terminal extraction direction X1) which are located more forward than rocking fulcrums E, E respectively located in the base portions.

The connector shown in FIG. 10 is similar to that of FIG. 7 in that a pair of elongated plate-like contact pieces C, C extend in the pin terminal insertion and extraction direction X and are symmetrically arranged in each of the pin terminal insertion spaces B formed in the insulating body A, in that the contact pieces C, C are electrically connected with each other by a short-circuit portion D made of a thin metal plate, and in that the short-circuit portion D and the contact pieces C, C are formed into one body by punching or bending a thin metal plate which is common to them. In the connector shown in FIG. 10, however, contacts F, F corresponding to a pin terminal G1 or G2 are at positions (given positions in the pin terminal insertion direction X2) which are located more rearward than rocking fulcrums E, E respectively located in the base portions.

In FIGS. 7 and 10, B1 designates the body of the counter multipolar electrical connector.

A number of pin terminals of a counter connector disposed on a computer apparatus in which a memory card is to be used project from the connector body by lengths varying depending on the kind of signals to be processed. This is because, when the pin terminals of the counter connector are inserted into the pin terminal insertion spaces of a connector to connect the counter connector with the connector, the contact timings between the pin terminals through which signals of different kinds pass and the corresponding contact pieces of the connector are temporarily shifted from each other in accordance with the kinds of the signals.

The connector described in conjunction with FIG. 7 has higher reliability with respect to that, when the two kinds of pin terminals, the short pin terminal G1 and the long pin terminal G2 indicated by phantom lines in the figure are to be inserted, the timings of contacting the pin terminals G1 and G2 with the contacts F . . . of the corresponding contact pieces C . . . (the contact pieces corresponding to the long pin terminal G2 are not shown) are surely temporarily shifted from each other. More specifically, the pin terminal G1 collides with the contacts F, F immediately before the pin terminal G1 is inserted into the lap position of the paired contact pieces C, C (the position where the contact pieces C, C overlap with each other in the thickness direction T of the body A). It is impossible for the pin terminal G1 to contact any portion of the contact pieces C, C before the pin terminal G1 collides with the contacts F, F. This is applicable also to the long pin terminal G2. As a result, it is possible to assure the above-mentioned temporal shift between the contact timings.

However, the contacts F, F are located more forward than the rocking fulcrums E, E which are respectively located in the base portions of the contact pieces C, C. Accordingly, when, in the insertion process of the pin terminals, the short pin terminal G1 collides with the contacts F, F, for example, a part of the force generated by the collision is received by the rocking fulcrums E, E, whereby a large force is generated so as to impede the insertion of the pin terminal G1. This causes the force (insertion force) required for inserting the pin terminal G1 to be increased. Also for the long pin terminal G2, there arises the same situation as that of the short pin terminal G1. Since the pin terminals G1 and G2 respectively correspond to pairs of the contact pieces C, C and a number of the pin terminals G1 . . . and G2 . . . strike the corresponding contacts F . . . in the insertion process of a multipolar electrical connector, it is necessary to exert a large insertion force, whereby the operability in the insertion process is impaired. To comply with this, a configuration may be adopted in which a single contact piece is allocated to one pin terminal so that the operability in the insertion process is improved. In this configuration, however, each pin terminal contacts with only one contacting point, and therefore contact stability is lowered.

The connector described in conjunction with FIG. 8 has a configuration in which the contact pieces C, C are difficult to bend in the directions separating from each other. In this connector, therefore, the force of inserting the pin terminals may be larger than that in the connector of FIG. 7, so that operability in the insertion process is further impaired as compared with that of FIG. 7. Since the edge faces which are formed as a result of a punching process of a thin metal plate function as the contacts F, F, moreover, the maximum width of the contacts F, F is restricted to the thickness of the thin metal plate. When a pin terminal inserted between the contacts F, F is deviated with a somewhat large degree in the width direction of the contacts F, F (the thickness direction, or the direction perpendicular to the sheet in FIG. 8), therefore, it is not possible to absorb the deviation.

In the configuration of the connector described in conjunction with FIG. 9, when a pin terminal is inserted, the two contacts F, F sequentially collide with the pin terminal. Therefore, the operability in the insertion process is improved as compared with that of FIG. 7. In order to equalize the effective lengths L1 and L2 of the contact pieces C, C to each other while keeping the contact pressures against the pin terminal equal to each other, however, the contact piece C having the contact F which is located rearward must be shifted backward from the position of the contact piece C having the contact F which is located forward, by the distance corresponding to the shifting distance between the contacts F, F. This increases the whole length of the connector, thereby impeding the miniaturization.

In the connector of FIG. 10, the contacts F, F are located more rearward than the rocking fulcrums E, E which are located in the base portions of the contact pieces C, C. According to this configuration, when the short pin terminal G1 collides with the contacts F, F in the insertion process, for example, it occurs only that the paired contact pieces C, C swing about the respective rocking fulcrums E, E, and the situation that the force generated by the collision of the pin terminal G1 against the contacts F, F is received by the rocking fulcrums E, E does not occur. Accordingly, a large force of hindering the pin terminal from being inserted is not generated, and therefore the insertion force for the pin terminal G1 can be smaller than that required in the connectors of FIGS. 7 and 8. Also for the long pin terminal G2, there arises the same situation as that of the short pin terminal G1. Although the pin terminals G1 and G2 respectively correspond to pairs of the contact pieces C, C and a number of the pin terminals G1 . . . and G2 . . . strike the corresponding contacts F . . . in the insertion process of a multipolar electrical connector, therefore, the required insertion force is not so large and operability is hardly impaired.

However, the connector has the following drawback. When the two kinds of pin terminals, the short pin terminal G1 and the long pin terminal G2 indicated by phantom lines in FIG. 10 are to be inserted, it is difficult to assure the temporary shift between the timings of contacting the pin terminals G1 and G2 with the contacts F of the corresponding contact pieces C . . . (the contact pieces corresponding to the long pin terminal G2 are not shown). More specifically, the pin terminal G1 collides with the contacts F, F after the pin terminal G1 is inserted into the lap position of the paired contact pieces C, C. If the pin terminal G1 is bent, therefore, there may arise a situation whereby the short pin terminal G1 contacts the corresponding contact piece C before the long pin terminal G2 collides with the corresponding contacts F, F. When such a situation occurs, it is impossible to assure the temporary shift between the contact timings of contacting the pin terminals G1 and G2 of the two kinds with the contacts.

As described above, in a prior art multipolar electrical connector for a memory card, the temporary shift between the timings of contacting contacts with pin terminals having different lengths can be assured at the sacrifice of operability in the insertion process. Further, a prior art multipolar electrical connector has a problem in that the prevention of an impaired operability in the insertion process is liable to be conducted at the sacrifice of the reliability with respect to the assurance of the temporary shift between the contact timings. Moreover, a prior art multipolar electrical connector has another problem in that, when the assurance of the temporary shift between the contact timings is attempted without sacrificing operability in the insertion process, miniaturization is impeded or the reliability of the contacting states between contacts and pin terminals is lowered.

SUMMARY OF THE INVENTION

The present invention was developed in view of the aforementioned circumstances and problems.

It is an object of the present invention to provide a connector in which both the reliability with respect to the assurance of the temporary shift between the timings of contacting contacts with pin terminals of two kinds, short and long pin terminals provided in a counter connector, and operability in the insertion process can be improved without sacrificing one of the two properties, reliability and operability.

It is another object of the present invention to provide a connector in which the reliability of the contacting states between contacts and pin terminals can be assured.

It is a further object of the present invention to provide a multipolar electrical connector for a memory card which can easily be miniaturized.

In order to accomplish the above-mentioned objects, the connector of the present invention comprises:

- a body which is to be attached to a front end portion of a body of a memory card, the body having a plurality of pin terminal insertion spaces into which pin terminals of a counter multipolar electrical connector are to be respectively inserted; and
- contact piece members which are housed in the pin terminal insertion spaces, respectively,
  - each of the contact piece members comprising:
  - a first elongated plate-like contact piece which has a contact corresponding to one of the pin terminals and extends in a pin terminal insertion and extraction direction, the contact being located more forward than a rocking fulcrum which is located in a base portion;
  - a second elongated plate-like contact piece which has a contact corresponding to the one pin terminal and extends in the pin terminal insertion and extraction direction, the contact being located more rearward than a rocking fulcrum which is located in a base portion, and the contact of the first contact piece; and a short-circuit portion for electrically connecting the first and second contact pieces with each other.

In the thus configured connector of the present invention, contact of the first contact piece functions as a timing contact for assuring a temporary shift between the contact timings with respect to pin terminals having different lengths. More specifically, since the contact of the first contact piece is located more forward than the rocking fulcrum which is located in the base portion, the pin terminal collides with the contact immediately before the pin terminal is inserted into the lap position of the pin terminal and the first contact piece, and it is impossible for the pin terminal to contact the first contact piece before the pin terminal collides with the contact. The force which is received by the rocking fulcrum of the first contact piece when the pin terminal strikes the first contact piece is reduced to half as compared with that in the connector of FIG. 7, so that the force of impeding the insertion of the pin terminal is also reduced to half as compared with that in the connector of FIG. 7.

The second contact piece corresponds to the contacts illustrated in conjunction with FIG. 10. Since the number of contact pieces is reduced to a half of that in the case of FIG. 8, the force of impeding the insertion of the pin terminal which is generated by the collision of the pin terminal against the second contact piece is reduced to half as compared with the case of FIG. 10.

Since the inserted pin terminal contacts with two points, i.e., the contacts of the first and second contact pieces, contact stability with respect to the pin terminal is equal to that of the connector of FIG. 7 or 10.

As described above, the connector of the present invention can attain effects that the reliability with respect to the assurance of the temporary shift between the timings of contacting the contacts with pin terminals having different lengths is high, that the operability in the insertion process is excellent, and that the contact reliability of the contacts with respect to pin terminals can be assured in the same degree as that in the prior art.

In the other connector of the present invention, the pin terminal insertion spaces are arranged in two elongated rows separated from each other in the thickness direction of the body, and each of the rows extends in the width direction of the body and consists of two or more pin terminal insertion spaces.

For the same number of poles, the body width of the connector of this configuration is a half of that of a connector comprising pin terminal insertion spaces arranged in one row.

In the further connector of the present invention, the first and second contact pieces and the short-circuit portion are formed into one body by conducting a mechanical process on a thin metal plate, the first and second contact pieces are located to be displaced from each other by 180 deg., the thin metal plate is made of a rolled material, and the contacts of the first and second contact pieces are respectively formed on faces which are formed by rolling the material.

The thus configured connector can assure a wide width of the contacts of the first and second contact pieces. Accordingly, even when a pin terminal inserted between the contacts deviates by with a large degree in the width direction of the contacts, the deviation can be absorbed.

These and other features, objects and advantages of the present invention will be more fully apparent from the following description of embodiments thereof.

DETAILED DESCRIPTION OF THE PREFERRED EMBODIMENT

Figure 1:
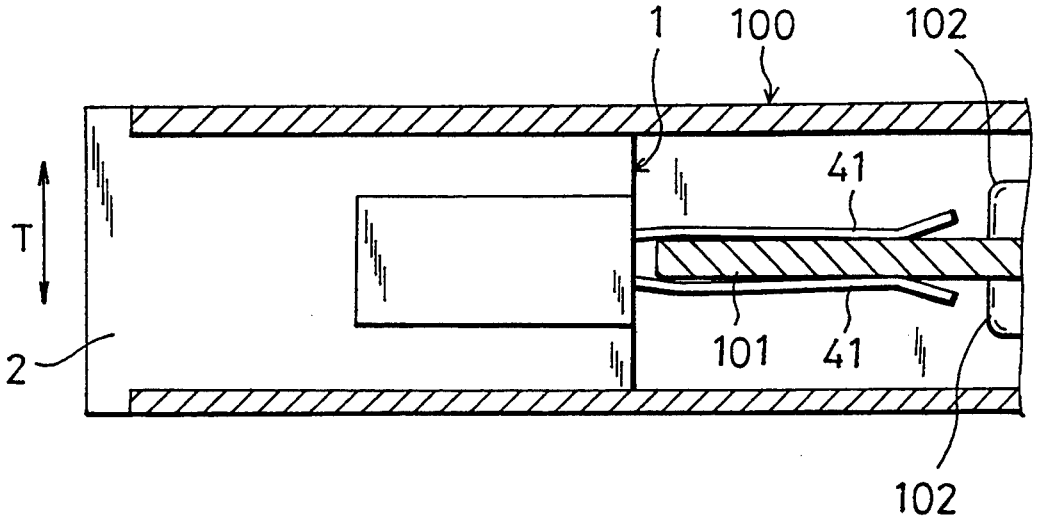
FIG. 1 is a partially broken section view of a memory card to which a connector according to an embodiment of the invention is attached.

As shown in FIG. 1, a connector 1 is attached to the front end portion of the body 100 of a memory card so as to be united with the body. The reference numeral 101 designates a wiring board, and 102 designates devices mounted on the wiring board 101.

Figure 2:
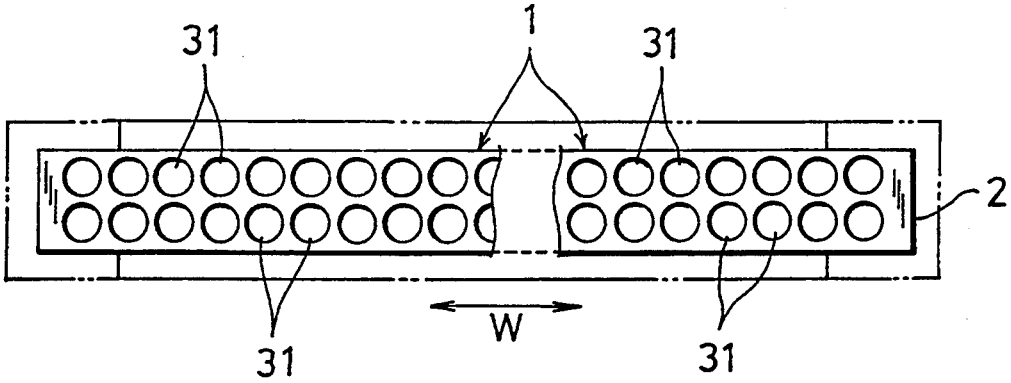
FIG. 2 is a partial front view showing the connector and a connector guide.
Figure 5:
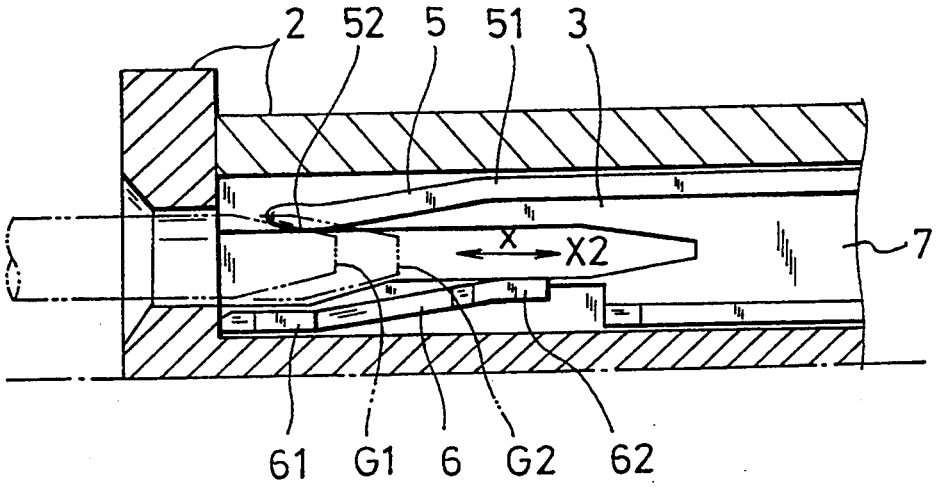
FIG. 5 is a diagram illustrating a state where a pin terminal collides with contacts of the connector.
Figure 6:
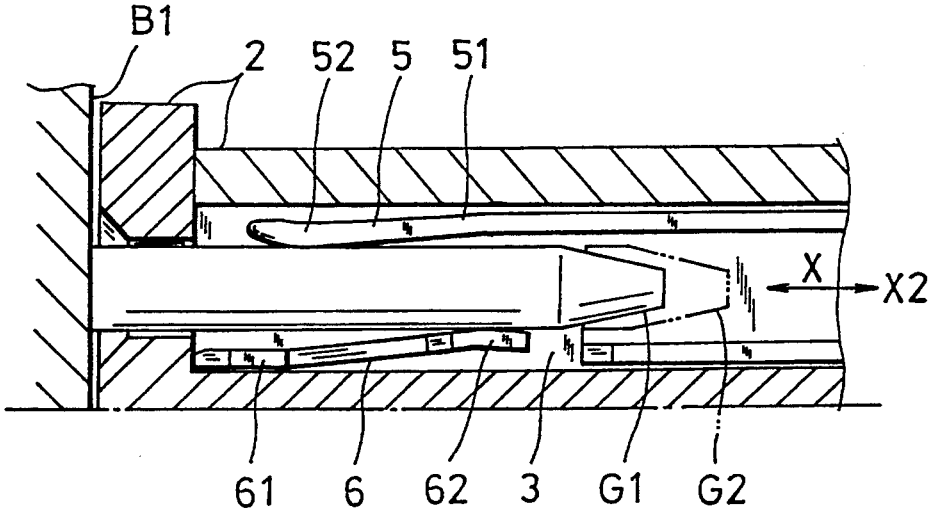
FIG. 6 is a diagram illustrating a state where a pin terminal is inserted into a pin terminal insertion space of the connector.

As shown in FIGS. 5 and 6, the insulating body 2 of the connector 1 is provided with a number of pin terminal insertion spaces 3 . . . into which pin terminals G1 and G2 of a counter multipolar electrical connector (not shown) are to be respectively inserted. The pin terminal insertion spaces 3 . . . are arranged in juxtaposition so as to form two rows separated from each other in the thickness direction T (FIG. 1) of the body 2 which has a shape of a thin plate. Each of the rows extends in the width direction W (FIG. 2) of the body 2 and consists of two or more pin terminal insertion spaces. As shown in FIG. 2, pin terminal insertion holes 31 . . . respectively corresponding to the pin terminal insertion spaces 3 are opened on the front end face of the body 2.

Figure 3:
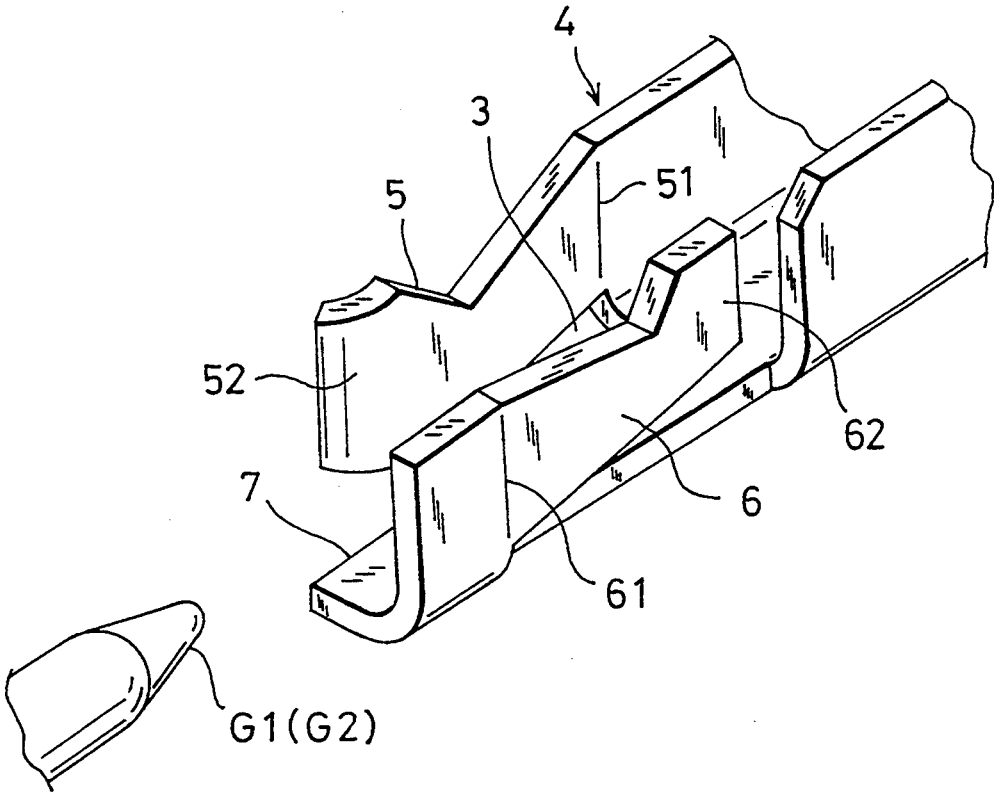
FIG. 3 is a partial perspective view showing a contact piece member and a pin terminal.
Figure 4:
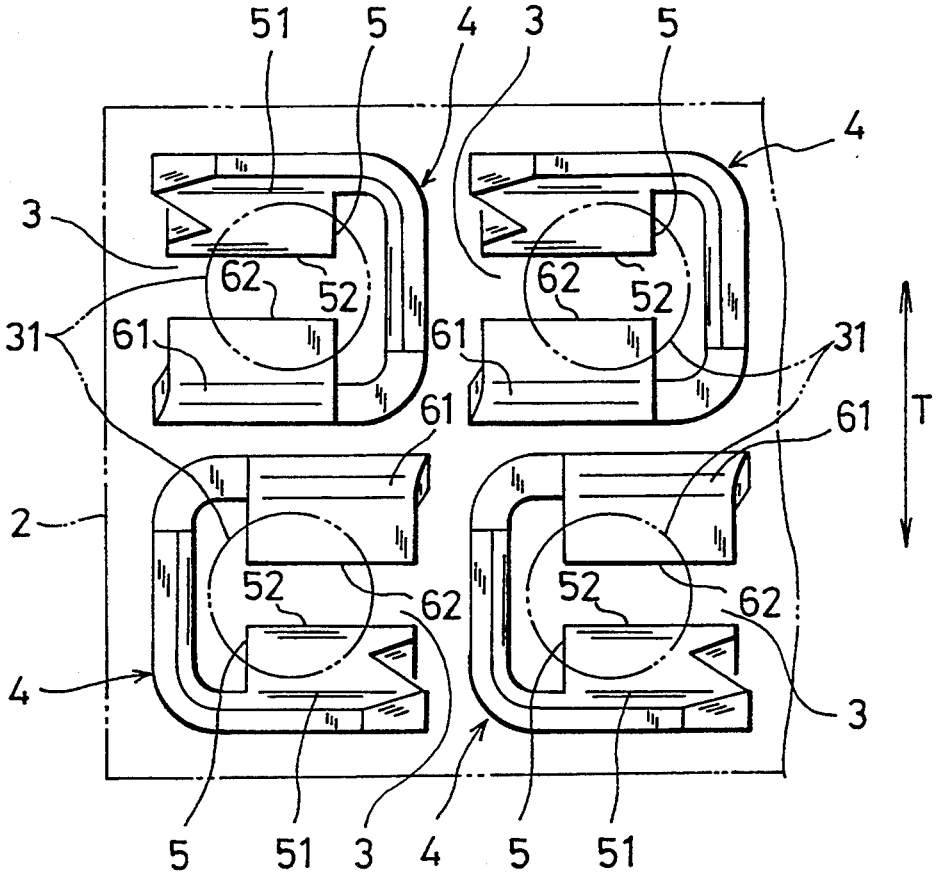
FIG. 4 is a diagram illustrating the assembling posture of the contact piece members on a body.

In each of the pin terminal insertion spaces 3 . . . , a contact piece member 4 shown in FIG. 3 is housed so as to have a predetermined posture. The contact piece member 4 comprises a single first plate-like contact piece 5, a single second plate-like contact piece 6, and a single plate-like short-circuit portion 7 which are formed by conducting mechanical processes such as punching and bending on a thin metal plate that is a rolled material, so that the resulting contact piece member has a U-like shape in front view. One contact piece member 4 having this configuration is housed in each of the pin terminal insertion spaces 3 . . . . As shown in FIG. 4, a number of pin terminal insertion spaces 3 . . . are arranged in two rows, an upper row formed in the upper portion of the body 2, and a lower row formed in the lower portion of the body 2. The contact piece members 4 . . . are housed in the pin terminal insertion spaces 3. . . , in such a manner that the open side of the U-shape of each of the members 4 in the upper row is faces to the same lateral direction, and that of the U-shape of each of the members 4 in the lower row face the same direction which is opposite to the lateral direction. The first contact piece 5 extends forward from a rocking fulcrum 51 located in the base portion, in the pin terminal insertion and extraction direction X (FIGS. 5 and 6). An arcuate contact 52 is provided at the front end portion of the first contact piece. In the first contact piece 5, therefore, the contact 52 is located more forward than the rocking fulcrum 51. The second contact piece 6 extends rearward from a rocking fulcrum 61 located in the base portion, in the pin terminal insertion and extraction direction X (FIGS. 5 and 6). An arcuate contact 62 is provided at the rear end portion of the second contact piece. In the second contact piece 6, therefore, the contact 62 is located more rearward than the rocking fulcrum 61. The second contact piece 6 is opposed to the first contact piece 5, and the contact 62 of the second contact piece 6 is located more rearward than the contact 52 of the first contact piece 5. The short-circuit portion 7 electrically connects the first contact piece 5 with the second contact piece 6.

In this embodiment, the first and second contact pieces 5 and 6 are located so as to be displaced from each other by 180 deg. The contacts 52 and 62 of the first and second contact pieces 5 and 6 are respectively formed on faces which are formed by rolling a material.

As shown in FIG. 1, connecting terminals 41 protruding rearward from the respective contact piece members 4 . . . are connected with circuits on the wiring board 101 housed in the memory card body 100.

According to the connector having the configuration described above, the contact 52 of the first contact piece 5 functions as a timing contact for assuring a temporary shift between the contact timings with respect to the pin terminals G1 and G2 having different lengths. More specifically, the contact 52 of the first contact piece 5 is located more forward than the rocking fulcrum 51. When, for example, the short pin terminal G1 is inserted into the corresponding pin terminal insertion space 3, therefore, the pin terminal G1 first collides with the contact 52 as shown in FIG. 5 to move the first contact piece 5 in the direction leaving from the second contact piece 6, and then further inserted to reach the lap position of the pin terminal G1 and the first contact piece 5 (the position where the pin terminal G1 and the first contact piece 5 overlap with each other in the thickness direction T of the body 2). Accordingly, it is impossible for the pin terminal G1 to collide or contact any portion other than the contact 52 of the first contact piece 5 before the pin terminal G1 collides with the contact 52. This is applicable also to the long pin terminal G2. When the pin terminals G1 and G2 of the counter connector which have different lengths are inserted into the pin terminal insertion spaces 3 . . . of the connector, therefore, the long pin terminal G2 first contacts the contact 52 of the first contact piece 5 corresponding to the terminal, and then the short pin terminal G1 contacts the contact 52 of the first contact piece 5 corresponding to the terminal. This results in the temporary shift between the contact timings being assured even when the pin terminal G1 or G2 is somewhat deformed. Moreover, since only one first contact piece 5 is provided for each of the pin terminals G1 and G2, the force which is received by the rocking fulcrum 51 when the pin terminal G1 or G2 collides with the first contact piece 5 is small, and also the force of impeding the insertion of the pin terminals G1 and G2 is reduced.

Figure 7:
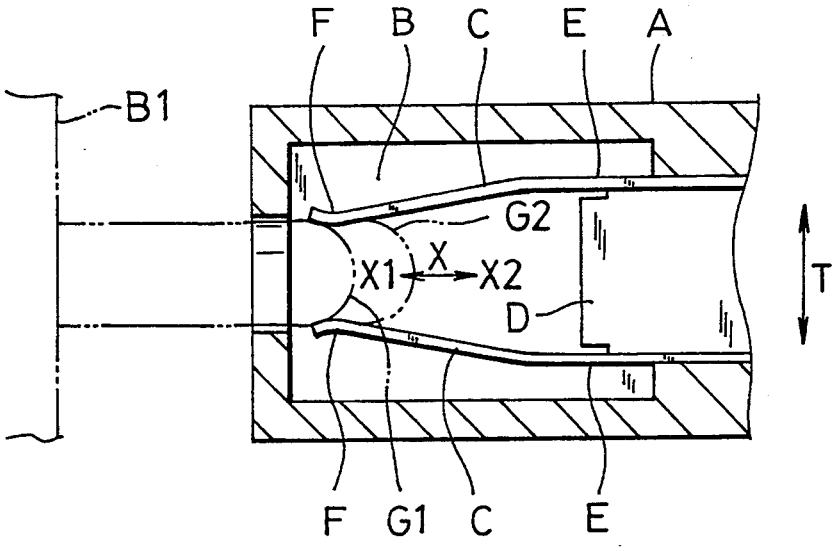
Fig.7 (PRIOR ART)
FIG. 7 is a section view illustrating a prior art connector.
Figure 8:
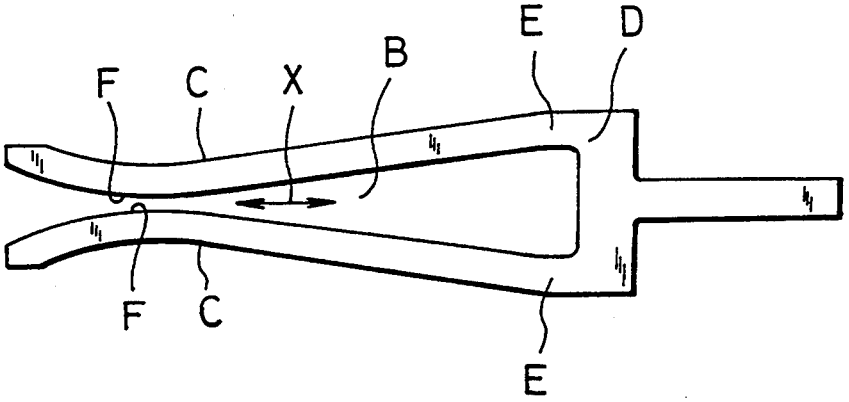
Fig.8 (PRIOR ART)
FIG. 8 is a section view illustrating another prior art multipolar electrical connector for a memory card.
Figure 9:
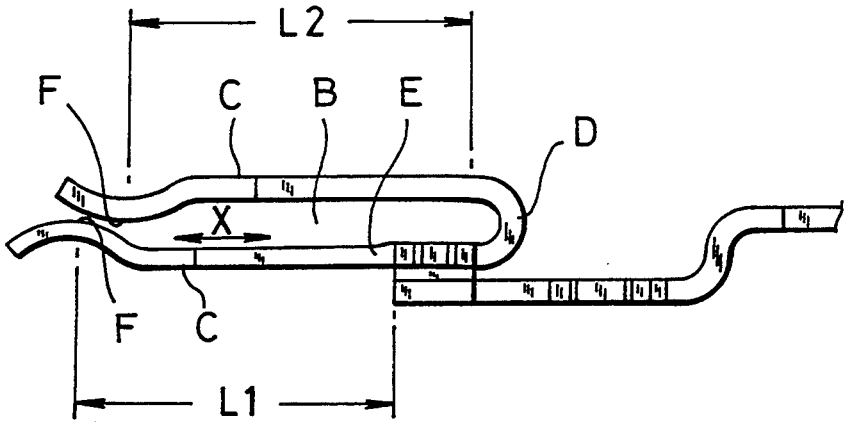
Fig.9 (PRIOR ART)
FIG. 9 is a section view illustrating a further prior art multipolar electrical connector for a memory card.
Figure 10:
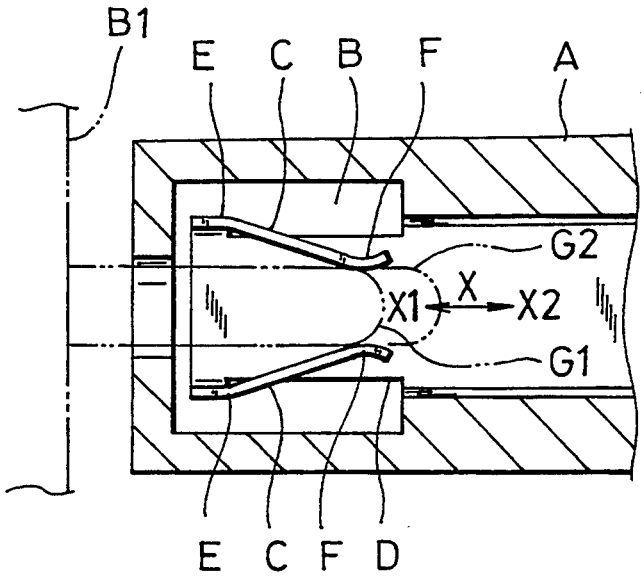
Fig.10 (PRIOR ART)
FIG. 10 is a section view illustrating a still further prior art multipolar electrical connector for a memory card.

When the pin terminal G1 is further inserted after reaching the lap position of the pin terminal G1 and the first contact piece 5, the pin terminal G1 collides with the contact 62 of the second contact piece 6 to displace the second contact piece 6 about the rocking fulcrum 61 in the direction leaving from the first contact piece 5. In the second contact piece 6, the contact 62 is located at a position which is more rearward than the rocking fulcrum 61 (i.e., a position in the pin terminal insertion direction X2). When the pin terminal G1 or G2 collides with any portion of the second contact piece 6, therefore, the rocking fulcrum 61 does not receive the force generated by the collision, resulting in the insertion impeding force which is generated when the pin terminal G1 or G2 collides with the second contact piece 6 not being so large. Moreover, since only one second contact piece 6 is provided for each of the pin terminals G1 and G2, the force of impeding the insertion of the pin terminals G1 and G2 is very small. When the pin terminals G1 and G2 are completely inserted, each of the pin terminals G1 and G2 makes a contact at two points, or contacts with the contact 52 of the first contact piece 5 and the contact 62 of the second contact piece 6 as shown in FIG. 6, so that the contact stability with respect to the pin terminals G1 and G2 is equal to that of the prior art connectors described in conjunction with FIGS. 7 and 8.

As shown in detail in FIG. 3, the first contact piece 5 extends forward from the rocking fulcrum 51, the second contact piece 6 extends rearward from the rocking fulcrum 61, and the first and second contact pieces 5 and 6 are located so as to be displaced from each other by 180 deg. This configuration prevents the portion including the two contact pieces 5 and 6, from becoming longer in the front-to-back direction than the contact piece 5 or 6, whereby the miniaturization of the contact pieces 5 and 6 and also that of the connector can be realized.

Further, since the contacts 52 and 62 of the first and second contact pieces 5 and 6 are respectively formed on faces which are formed by rolling a material, the widths (the widths in the vertical direction in FIG. 3) of the contacts can be increased. Accordingly, the contacts 52 and 62 can be provided respectively with widths which are so great that, even when the pin terminal G1 or G2 inserted into the respective pin terminal insertion space 3 is deviated in the vertical direction, the deviation can be sufficiently absorbed.

What is claimed is:

1. A multipolar electrical connector for a memory card, comprising:

a body which is to be attached to a front end portion of a body of the memory card, said body having a plurality of pin terminal insertion spaces into which pin terminals of a counter multipolar electrical connector are to be respectively inserted; and contact piece members housed in each of said pin terminal insertion spaces, respectively, each of said contact piece members comprising:

an elongated first plate-like contact piece which has a base portion defining a rocking fulcrum, and a contact corresponding to one of said pin terminals which extends in a pin terminal insertion and extraction direction, said contact being located more forward than its associated rocking fulcrum which is located in its associated base portion;

an elongated second plate-like contact piece which has a base portion defining a rocking fulcrum, and a contact corresponding to said one pin terminal which extends in the pin terminal insertion and extraction direction, said contact being located more rearward than its associated rocking fulcrum which is located in its associated base portion, and said contact of said first contact piece; and a short-circuit portion for electrically connecting said first and second contact pieces with each other.

2. A multipolar electrical connector for a memory card according to claim 1, wherein said pin terminal insertion spaces are arranged in two rows separated from each other in the thickness direction of said body, and each of said rows extends in the width direction of said body and consists of two or more pin terminal insertion spaces.

3. A multipolar electrical connector for a memory card according to claim 2, wherein pin terminal insertion holes respectively corresponding to said pin terminal insertion spaces are opened on a front end face of said body.

4. A multipolar electrical connector for a memory card according to claim 2, wherein said first and second contact pieces and said short-circuit portion are formed into one body by mechanically processing a thin metal plate.

5. A multipolar electrical connector for a memory card according to claim 4, wherein said first and second contact pieces are located to be displaced from each other by 180 deg.

6. A multipolar electrical connector for a memory card according to claim 5, wherein said thin metal plate is made of a rolled material, and said contacts of said first and second contact pieces are respectively formed on faces which are formed by rolling said material.

7. A multipolar electrical connector for a memory card according to claim 2, wherein connecting terminals protruding rearward from the respective contact piece members are connected with circuits on a wiring board housed in said body of said memory card.

8. A multipolar electrical connector for a memory card according to claim 5, wherein the contact piece members respectively housed in the pin terminal insertion spaces of the same row face in the same lateral direction, and the contact piece members respectively housed in the pin terminal insertion spaces of the other row face in the same direction which is opposite to said lateral direction.

* * * * *